US005642574A

United States Patent [19]

Caddy

[11] Patent Number: 5,642,574

[45] Date of Patent: Jul. 1, 1997

[54] HEATED INSULATION BOOT

[76] Inventor: Larry C. Caddy, 2305 Vondera St., Munhall, Pa. 15120

[21] Appl. No.: 673,570

[22] Filed: Jul. 1, 1996

[51] Int. Cl.[6] ..... A43B 7/02

[52] U.S. Cl. ..... 36/2.6; 36/136

[58] Field of Search ..... 36/2.6, 136

[56] References Cited

U.S. PATENT DOCUMENTS

| | | | |
|---|---|---|---|
| 4,094,080 | 6/1978 | Sanders | 36/2.6 |
| 4,249,319 | 2/1981 | Yoshida | 36/2.6 |
| 4,373,274 | 2/1983 | Michalski | 36/2.6 |
| 4,455,764 | 6/1984 | Rock et al. | 36/2.6 X |
| 4,841,646 | 6/1989 | Maurer, Jr. | 36/2.6 |

FOREIGN PATENT DOCUMENTS

| | | | |
|---|---|---|---|
| 3342276 | 6/1985 | Germany | 36/2.6 |

*Primary Examiner*—Ted Kavanaugh

[57] ABSTRACT

A heated insulation boot including a boot portion having an open upper portion, a closed lower sole portion, a heel portion and an insulated toe portion. An upper portion of the insulated toe portion has a circular recess formed therein. A cover portion is included and having a generally circular configuration. The cover portion has a flexible member coupled to the upper portion of the insulated toe portion of the boot portion adjacent to the circular recess. A heating packet is removably positioned within the circular recess of the insulated toe portion of the boot portion.

7 Claims, 3 Drawing Sheets

HEATED INSULATION BOOT

BACKGROUND OF THE INVENTION

1. Field of the Invention

The present invention relates to a heated insulation boot and more particularly pertains to maintaining warmth for a wearers feet with a heated insulation boot.

2. Description of the Prior Art

The use of heated boots is known in the prior art. More specifically, heated boots heretofore devised and utilized for the purpose of retaining heat within boots are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,658,515 to Oatman discloses a heat insulating insert for footwear.

U.S. Pat. No. 4,094,080 to Sanders discloses a boot or shoe heating device.

U.S. Pat. No. 5,084,986 to Usui discloses a disposable warmer holder.

U.S. Pat. No. 5,345,700 to Norment discloses an athletic shoe with replaceable unitary assembly for generating and broadcasting an audible signal.

Des. U.S. Pat. No. 345,853 to Blankenship discloses the ornamental design for a shoe with side pocket and lateral pouch.

While these devices fulfill their respective, particular objective and requirements, the aforementioned patents do not describe a heated insulation boot for maintaining warmth for a wearers feet.

In this respect, the heated insulation boot according to the present invention substantially departs from the conventional concepts and designs of the prior art, and in doing so provides an apparatus primarily developed for the purpose of maintaining warmth for a wearers feet.

Therefore, it can be appreciated that there exists a continuing need for new and improved heated insulation boot which can be used for maintaining warmth for a wearers feet. In this regard, the present invention substantially fulfills this need.

SUMMARY OF THE INVENTION

In the view of the foregoing disadvantages inherent in the known types of heated boots now present in the prior art, the present invention provides an improved heated insulation boot. As such, the general purpose of the present invention, which will be described subsequently in greater detail, is to provide a new and improved heated insulation boot and method which has all the advantages of the prior art and none of the disadvantages.

To attain this, the present invention essentially comprises a boot portion having an open upper portion, a closed lower sole portion, a heel portion and an insulated toe portion. The insulated toe portion comprises an interior gel lining, an intermediate insulating lining and an exterior lining. An upper portion of the insulated toe portion has a circular recess formed therein extending through the exterior lining and the intermediate insulating lining thereof to abut the interior gel lining. An annular flange surrounds an outer periphery of the recess and extends upwardly from the intermediate insulating lining. An annular hook and loop material is disposed around the annular flange. The device includes a cover portion having a generally circular configuration. The cover portion has a flexible member coupled to the exterior lining of the upper portion of the insulated toe portion of the boot portion adjacent to the circular recess. The cover portion comprises an upwardly curved insulated interior layer, an intermediate layer and a rubber coated exterior layer. The cover portion has a downwardly extending outer peripheral edge. The outer peripheral edge has an annular recess formed therein and an annular hook and loop material disposed around the annular recess whereby in a closed configuration the annular recess cooperates with the annular flange of the circular recess and the hook and loop material of the cover portion cooperates with the hook and loop material of the circular recess. The outer peripheral edge has a lifting tab extending outwardly therefrom. The cover portion has a plurality of apertures therethrough. Each of the apertures has a grommet disposed therein. A heating packet is removably positioned within the circular recess of the insulated toe portion of the boot portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved heated insulation boot which has all the advantages of the prior art heated boots and none of the disadvantages.

It is another object of the present invention to provide a new and improved heated insulation boot which may be easily and efficiently manufactured and marketed.

It is a further object of the present invention to provide a new and improved heated insulation boot which is of durable and reliable construction.

An even further object of the present invention is to provide a new and improved heated insulation boot which is susceptible of a low cost of manufacture with regard to both materials and labor, and which accordingly is then susceptible of low prices of sale to the consuming public, thereby making such a heated insulation boot economically available to the buying public.

Still yet another object of the present invention is to provide a new and improved heated insulation boot which provides in the apparatuses and methods of the prior art some of the advantages thereof, while simultaneously overcoming some of the disadvantages normally associated therewith.

Even still another object of the present invention is to provide a new and improved heated insulation boot for maintaining warmth for a wearers feet.

Lastly, it is an object of the present invention to provide a new and improved heated insulation boot including a boot portion having an open upper portion, a closed lower sole portion, a heel portion and an insulated toe portion. An upper portion of the insulated toe portion has a circular recess formed therein. A cover portion is included and having a generally circular configuration. The cover portion has a flexible member coupled to the upper portion of the insulated toe portion of the boot portion adjacent to the circular recess. A heating packet is removably positioned within the circular recess of the insulated toe portion of the boot portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
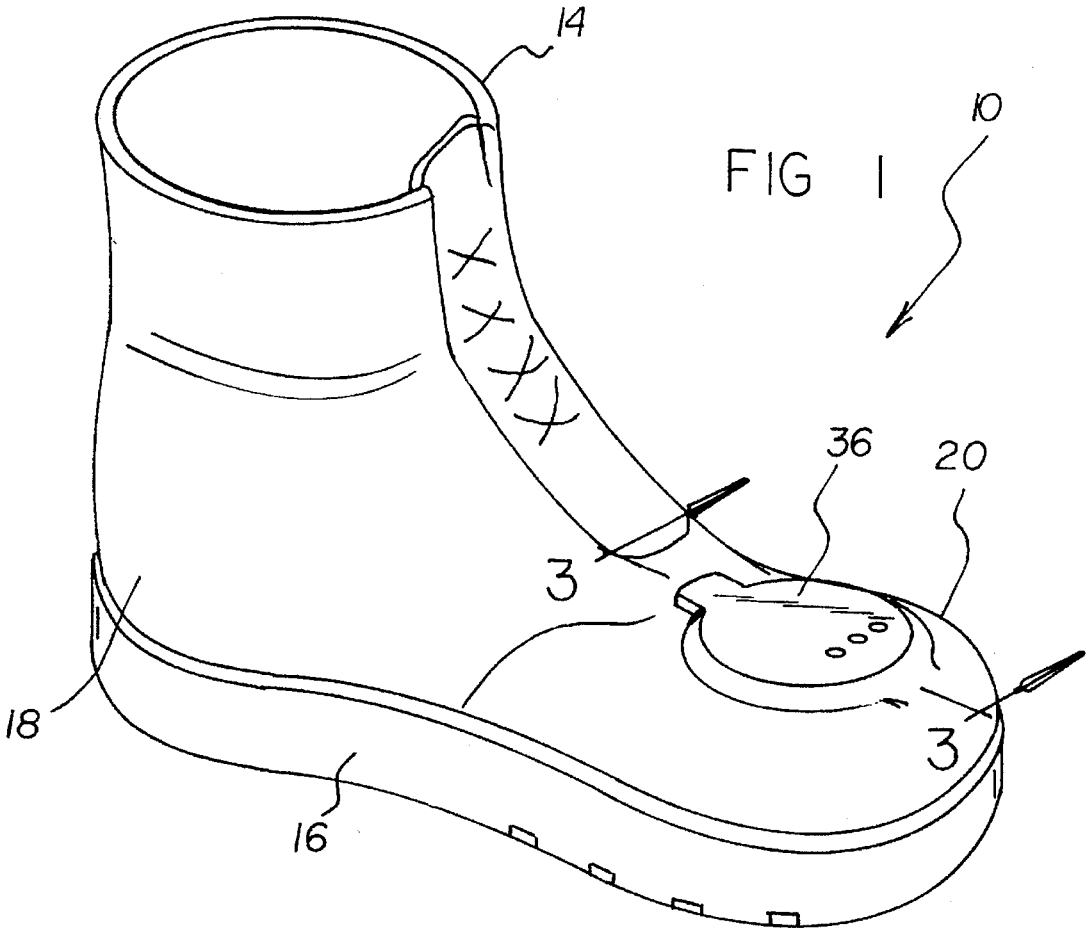
FIG. 1 is a perspective view of the preferred embodiment of the heated insulation boot constructed in accordance with the principles of the present invention.
Figure 2:
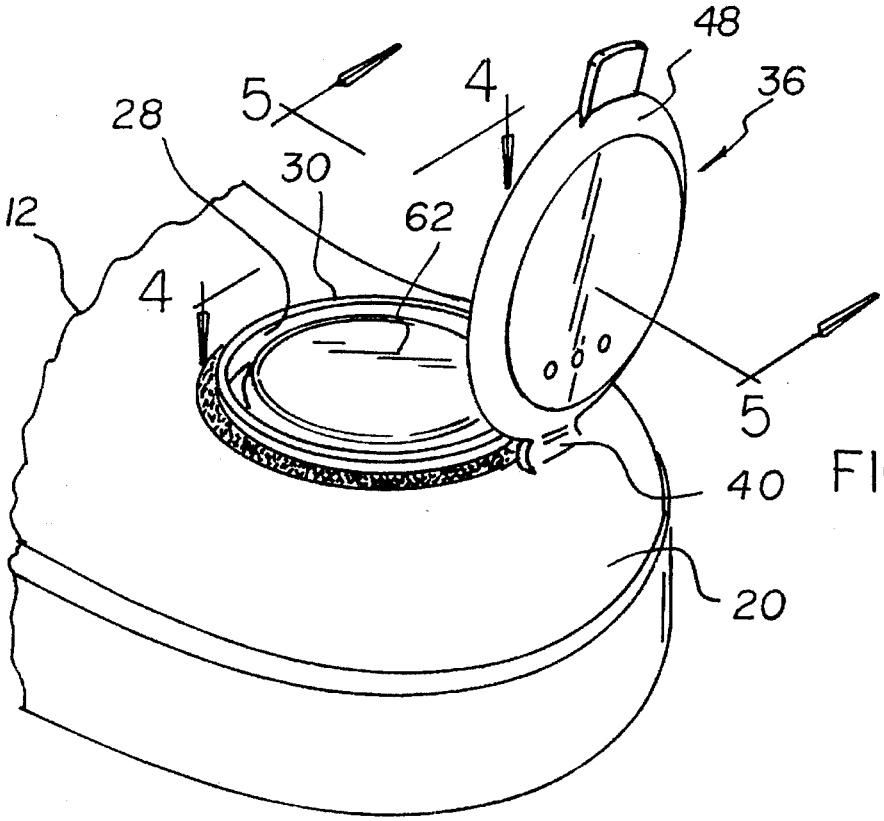
FIG. 2 is fragmentary perspective view of a toe portion of the present invention.
Figure 3:
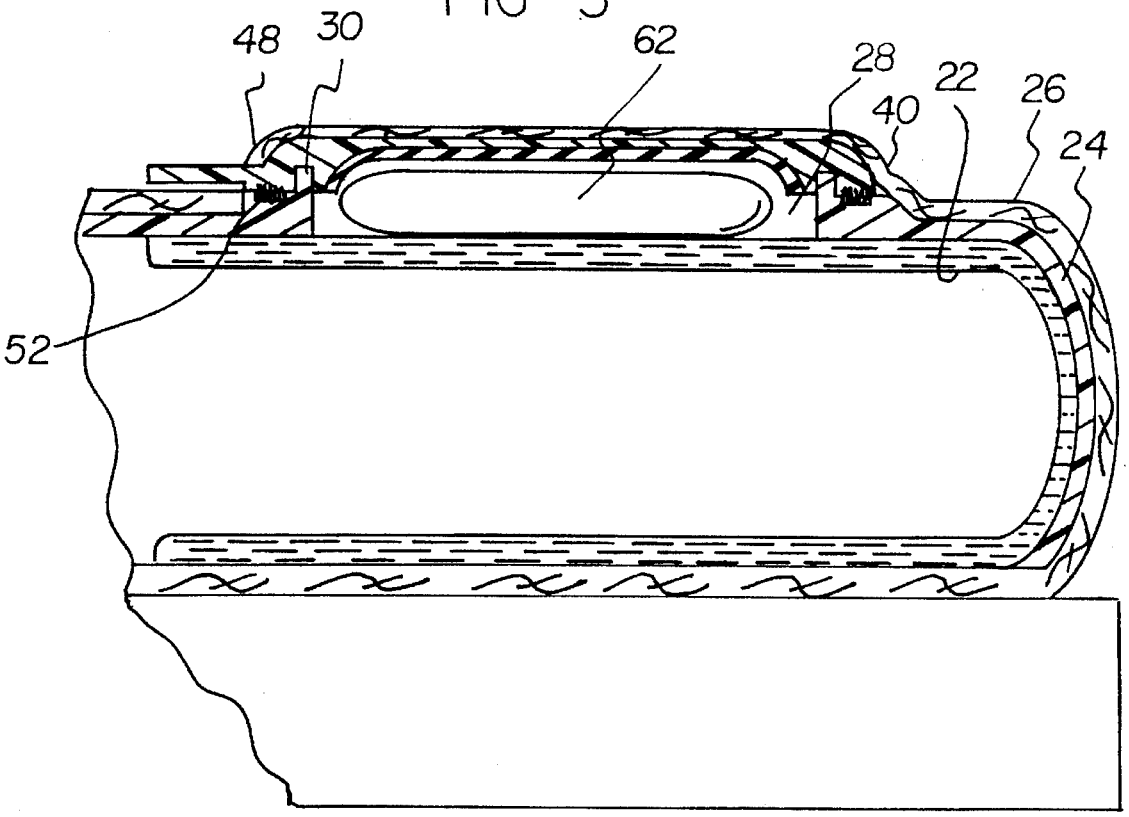
FIG. 3 is a cross-sectional view as taken along line 3—3 of FIG. 1.
Figure 4:
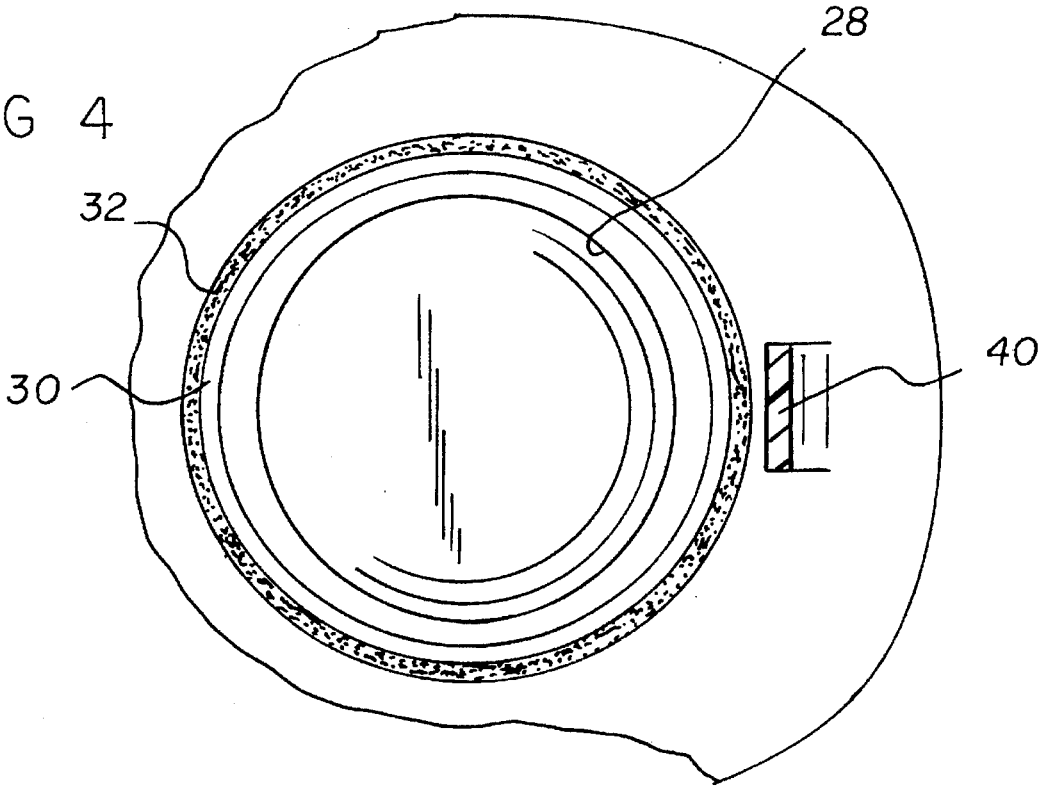
FIG. 4 is a cross-sectional view as taken along line 4—4 of FIG. 2.
Figure 5:
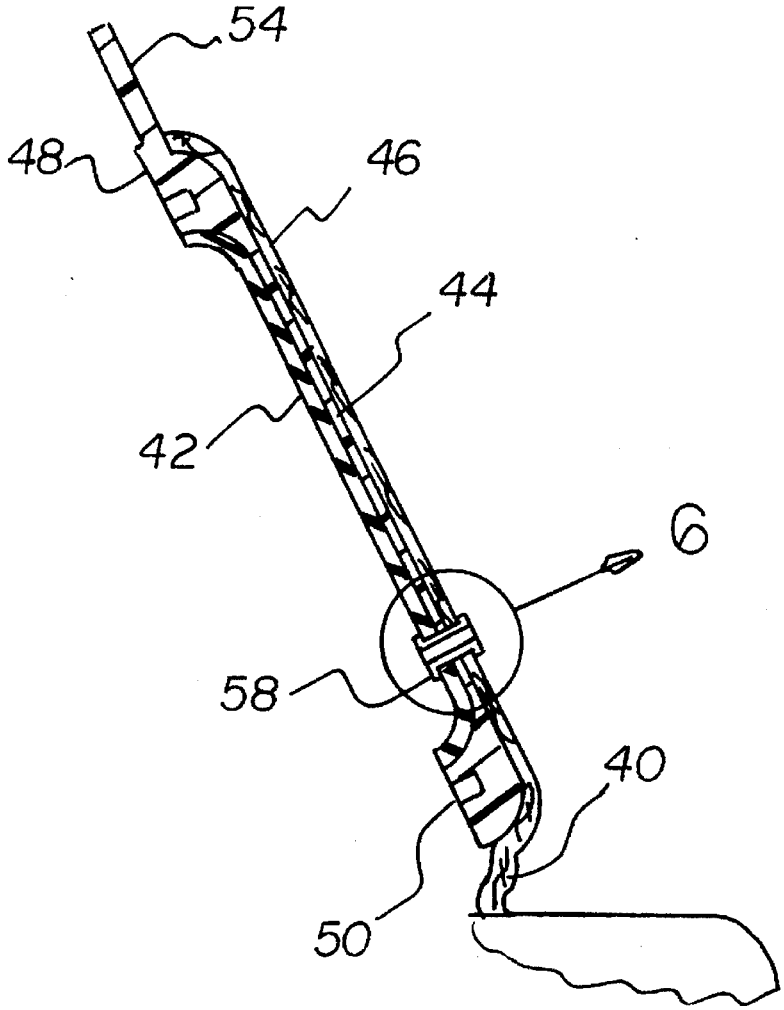
FIG. 5 is a cross-sectional view as taken along line 5—5 of FIG. 2.
Figure 6:
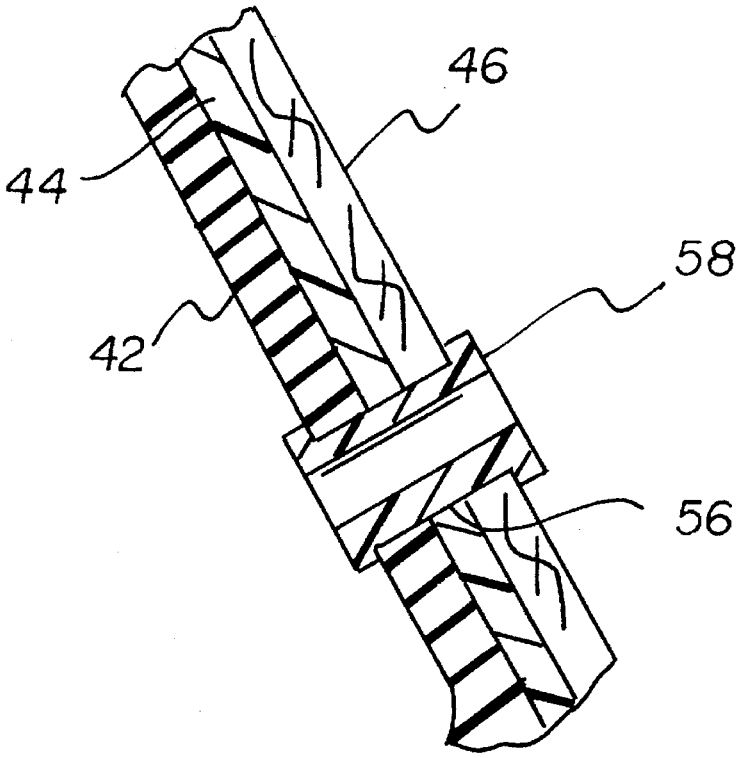
FIG. 6 is a fragmentary cross-sectional view as taken from circle 6 of FIG. 5.

With reference now to the drawings, and in particular, to FIGS. 1–6 thereof, the preferred embodiment of the new and improved heated insulation boot embodying the principles and concepts of the present invention and generally designated by the reference number 10 will be described.

Specifically, it will be noted in the various Figures that the device relates to a heated insulation boot for maintaining warmth for a wearers feet. In its broadest context, the device consists of a boot portion, a cover portion and a heating packet. Such components are individually configured and correlated with respect to each other so as to attain the desired objective.

The device 10 includes a boot portion 12 having an open upper portion 14, a closed lower sole portion 16, a heel portion 18 and an insulated toe portion 20. The insulated toe portion 20 comprises an interior gel lining 22, an intermediate insulating lining 24 and an exterior lining 26. An upper portion of the insulated toe portion 20 has a circular recess 28 formed therein extending through the exterior lining 26 and the intermediate insulating lining 24 thereof to abut the interior gel lining 22. An annular flange 30 surrounds an outer periphery of the circular recess 28 and extends upwardly from the intermediate insulating lining 24. An annular hook and loop material 32 is disposed around the annular flange 30. The boot portion 12 is fabricated of the various types of materials used in the art.

The device 10 includes a cover portion 36 having a generally circular configuration. The cover portion 36 has a flexible member 40 coupled to the exterior lining 26 of the upper portion of the insulated toe portion 20 of the boot portion 12 adjacent to the circular recess 28. The flexible member 30 allows for the cover portion 36 to be raised or lowered with respect to the circular recess 28. The cover portion 36 comprises an upwardly curved insulated interior layer 42, an intermediate layer 44 and a rubber coated exterior layer 46. The cover portion 36 has a downwardly extending outer peripheral edge 48. The outer peripheral edge 48 has an annular recess 50 formed therein and an annular hook and loop material 52 disposed around the annular recess 50 whereby in a closed configuration the annular recess 50 cooperates with the annular flange 30 of the circular recess 28 and the hook and loop material 52 of the cover portion 36 cooperates with the hook and loop material 32 of the circular recess 28. The outer peripheral edge 48 has a lifting tab 54 extending outwardly therefrom. The cover portion 36 has a plurality of apertures 56 therethrough. Each of the apertures 56 has a grommet 58 disposed therein. The apertures 56 provide ventilation to the device 10.

Lastly, a heating packet 62 is removably positioned within the circular recess 28 of the insulated toe portion 20 of the boot portion 12. The heating packet 62 serves to provide heat to the interior gel lining 22 of the insulated toe portion 20 thereby providing a constant heat to the wearer's toes. Once the wearer's toes became too warm, the cover portion 36 could be lifted to simply remove the heating packet 62.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A heated insulation boot for maintaining warmth for a wearers feet comprising, in combination:

a boot portion having an open upper portion, a closed lower sole portion, a heel portion and an insulated toe portion, the insulated toe portion comprising an interior gel lining, an intermediate insulating lining and an exterior lining, an upper portion of the insulated toe portion having a circular recess formed therein extending through the exterior lining and the intermediate insulating lining thereof to abut the interior gel lining, an annular flange surrounding an outer periphery of the recess and extending upwardly from the intermediate insulating lining, an annular hook and loop material disposed around the annular flange;

a cover portion having a generally circular configuration, the cover portion having a flexible member coupled to the exterior lining of the upper portion of the insulated toe portion of the boot portion adjacent to the circular recess, the cover portion comprising an upwardly curved insulated interior layer, an intermediate layer and a rubber coated exterior layer, the cover portion having a downwardly extending outer peripheral edge, the outer peripheral edge having an annular recess formed therein and an annular hook and loop material disposed around the annular recess whereby in a closed configuration the annular recess cooperates with the annular flange of the circular recess and the hook and loop material of the cover portion cooperates with the hook and loop material of the circular recess, the outer peripheral edge having a lifting tab extending outwardly therefrom, the cover portion having a plurality of apertures therethrough, each of the apertures having a grommet disposed therein; and a heating packet removably positioned within the circular recess of the insulated toe portion of the boot portion.

2. A heated insulation boot for maintaining warmth for a wearers feet comprising; in combination:

a boot portion having an open upper portion, a closed lower sole portion, a heel portion and an insulated toe portion, an upper portion of the insulated toe portion having an integral circular recess formed therein;

a cover portion having a generally circular configuration, the cover portion having a flexible member coupled to the upper portion of the insulated toe portion of the boot portion adjacent to the circular recess; and a heating packet removably positioned within the circular recess of the insulated toe portion of the boot portion wherein the insulated toe portion comprising an interior gel lining, an intermediate insulating lining and an exterior lining, the circular recess formed therein extends through the exterior lining and the intermediate insulating lining thereof to abut the interior gel lining.

3. The heat insulation boot as set forth in claim 2 wherein the cover portion comprising an upwardly curved insulated interior layer, an intermediate layer and a rubber coated exterior layer.

4. The heat insulation boot as set forth in claim 3 wherein an annular flange surrounding an outer periphery of the circular recess of the insulated toe portion and extending upwardly from the intermediate insulating lining, the cover portion having a downwardly extending outer peripheral edge, the outer peripheral edge having an annular recess formed therein whereby in a closed configuration the annular recess cooperates with the annular flange of the circular recess.

5. The heat insulation boot as set forth in claim 3 wherein an annular hook and loop material disposed around the circular recess of the insulated toe portion, the cover portion having an annular hook and loop material disposed around the annular recess whereby in a closed configuration the hook and loop material of the cover portion cooperates with the hook and loop material of the circular recess.

6. The heat insulation boot as set forth in claim 3 wherein an outer peripheral edge of the cover portion having a lifting tab extending outwardly therefrom.

7. The heat insulation boot as set forth in claim 3 wherein the cover portion having a plurality of apertures therethrough, each of the apertures having a grommet disposed therein.

* * * * *